US006367898B1

(12) United States Patent
Jobe

(10) Patent No.: US 6,367,898 B1
(45) Date of Patent: Apr. 9, 2002

(54) CABINET ASSEMBLY

(76) Inventor: Kevin Jobe, 391 Camas Creek Loop, Hamilton, MT (US) 59840

( * ) Notice: Subject to any disclaimer, the term of this patent is extended or adjusted under 35 U.S.C. 154(b) by 0 days.

(21) Appl. No.: 09/443,516

(22) Filed: Nov. 19, 1999

(51) Int. Cl.[7] ..... A47F 5/08
(52) U.S. Cl. ..... 312/246; 312/247; 312/266
(58) Field of Search ..... 312/245, 246, 312/247, 266, 248, 319.5, 319.7, 307, 325

(56) References Cited

U.S. PATENT DOCUMENTS

| | | | | | |
|---|---|---|---|---|---|
| 2,565,845 | A | * | 8/1951 | Frederick | 312/307 X |
| 2,648,516 | A | * | 8/1953 | Manetti et al. | 312/248 X |
| 2,882,113 | A | * | 4/1959 | Gantner | 312/248 |
| 3,028,209 | A | * | 4/1962 | Hinkel et al. | 312/319.7 |
| 3,224,827 | A | * | 12/1965 | Foster et al. | 312/266 |
| 3,460,876 | A | * | 8/1969 | De Boer | 312/246 |
| 3,519,319 | A | * | 7/1970 | Taylor | 312/307 X |
| 3,857,623 | A | | 12/1974 | Schneller | 312/266 |
| 4,026,434 | A | | 5/1977 | Howard | 312/247 X |
| 4,076,351 | A | | 2/1978 | Wyant | 312/247 |
| 4,915,461 | A | | 4/1990 | Kingsborough et al. | 312/247 |
| 5,076,649 | A | | 12/1991 | Therkelsen | 312/246 |
| 5,228,763 | A | | 7/1993 | Gingold | 312/266 |
| 5,249,858 | A | * | 10/1993 | Nusser | 312/325 X |
| 5,401,095 | A | * | 3/1995 | Williams et al. | 312/307 X |
| 5,567,028 | A | * | 10/1996 | Lutovsky et al. | 312/248 X |
| 5,772,295 | A | * | 6/1998 | Sundmark | 312/245 X |
| 5,820,076 | A | * | 10/1998 | Schumacher et al. | 312/247 X |
| 5,857,756 | A | * | 1/1999 | Fehre | 312/266 X |
| 6,000,770 | A | * | 12/1999 | Frich | 312/319.7 |

FOREIGN PATENT DOCUMENTS

| | | | | |
|---|---|---|---|---|
| JP | 6078829 | * | 3/1994 | 312/266 |

* cited by examiner

*Primary Examiner*—James O. Hansen
(74) *Attorney, Agent, or Firm*—Saliwanchik, Lloyd & Saliwanchik

(57) ABSTRACT

A cabinet assembly moves reversibly along a track on roller guide bearings which are attached to the cabinet housing. The cabinet assembly can be used, for example, in a kitchen setting and in place of an upper kitchen cabinet positioned above a countertop. The cabinet can be moved along the track from a position adjacent a wall, down toward the countertop, and out away from the wall allowing access to the contents of the cabinet to an individual seated in a wheelchair. Preferably, the cabinet is moved by a motorized hoist.

8 Claims, 4 Drawing Sheets

CABINET ASSEMBLY

BACKGROUND OF THE INVENTION

An estimated 1.7 million people in the United States are confined to wheelchairs. The passage of the Americans With Disabilities Act (1990) has heightened the awareness of the public to the special needs of the physically challenged. These needs however are many and specialized and as yet have not all been addressed.

A particular need of a wheelchair bound individual is the ability to access upper storage units. With storage space a premium in most homes and offices, utilizing only those cabinets accessible to an individual in a wheelchair is unacceptable. Therefore access, by all, to upper cabinets and storage units is essential.

A number of storage units have been devised that allow access to upper cabinets to persons in a wheelchair, short people or those with limited mobility. Kingsborough et al. describe a storage cabinet in which shelves are carried by pivotally mounted arms which allow the shelf to be swung outwardly and downwardly while maintaining a substantially horizontal attitude (U.S. Pat. No. 4,915,461). A cabinet having inner and outer cabinet assemblies provides access to cabinet contents when the inner assembly is mechanically lowered from the fixed outer cabinet assembly (U.S. Pat. No. 5,076,649). Schneller describes a pivotally mounting means by which the interior shelving or the entire cabinet can be swung down to an accessible height (U.S. Pat. No. 3,857,623). Pivotally mounted cabinet units which mount above a stairway (U.S. Pat. No. 4,026,434) or onto and behind a wall (U.S. Pat. Nos. 4,076,351 and 5,228,763, respectively) have also been described. Several of these units are motorized. Each unit however is based upon a pivot assembly which can be unstable, wear quickly and be unsafe. From the foregoing, it is apparent that there continues to be a need for accessible cabinet assemblies which are strong, reliable and safe.

SUMMARY OF THE INVENTION

The subject invention provides a cabinet assembly which can be moved reversibly from one position to another. In a preferred embodiment of the subject invention, a cabinet housing moves along a track on roller guide bearings. The cabinet assembly of the subject invention is particularly useful when installed as an upper storage unit in a kitchen. In a specific embodiment, the cabinet housing moves from a position adjacent an upper wall to a position away from that wall and down toward a countertop. This permits easy access of the cabinet's contents to an individual in a wheelchair. The cabinet housing can then be moved up off the countertop back against the wall freeing counter space for use. Preferably, the cabinet housing is moved by a motorized hoist.

DETAILED DESCRIPTION OF THE INVENTION

The subject invention provides a cabinet assembly in which a cabinet housing moves reversibly along a track on roller guide bearings. Preferably, the cabinet housing is moved by a motorized hoist. The cabinet assembly of the subject invention allows a storage unit to be moved effortlessly and safely to provide access to its contents by all individuals.

Figure 1:
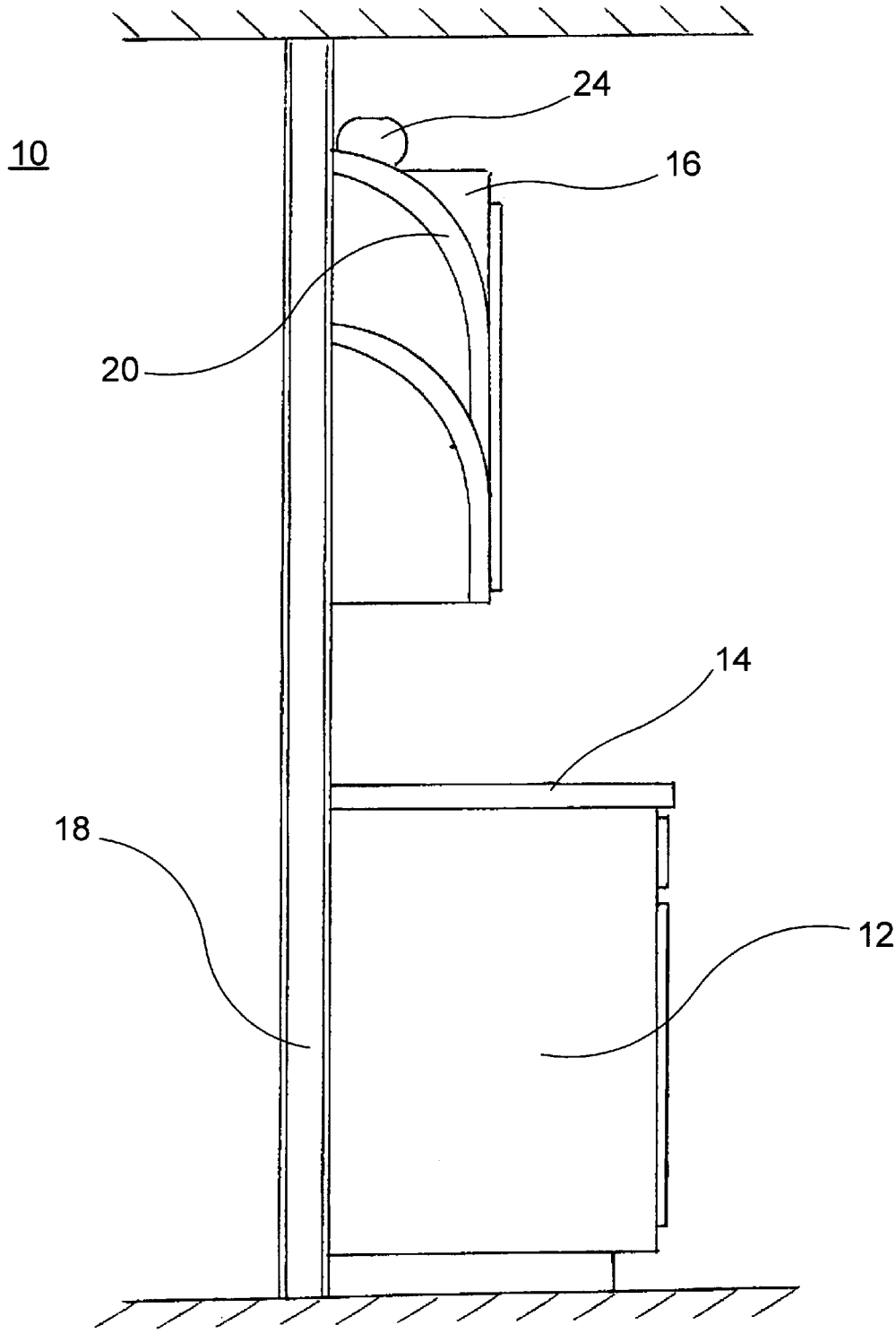
FIG. 1 is a side elevational view of a preferred embodiment of the cabinet assembly of the subject invention. In this view, the cabinet housing is positioned adjacent a wall.
Figure 2:
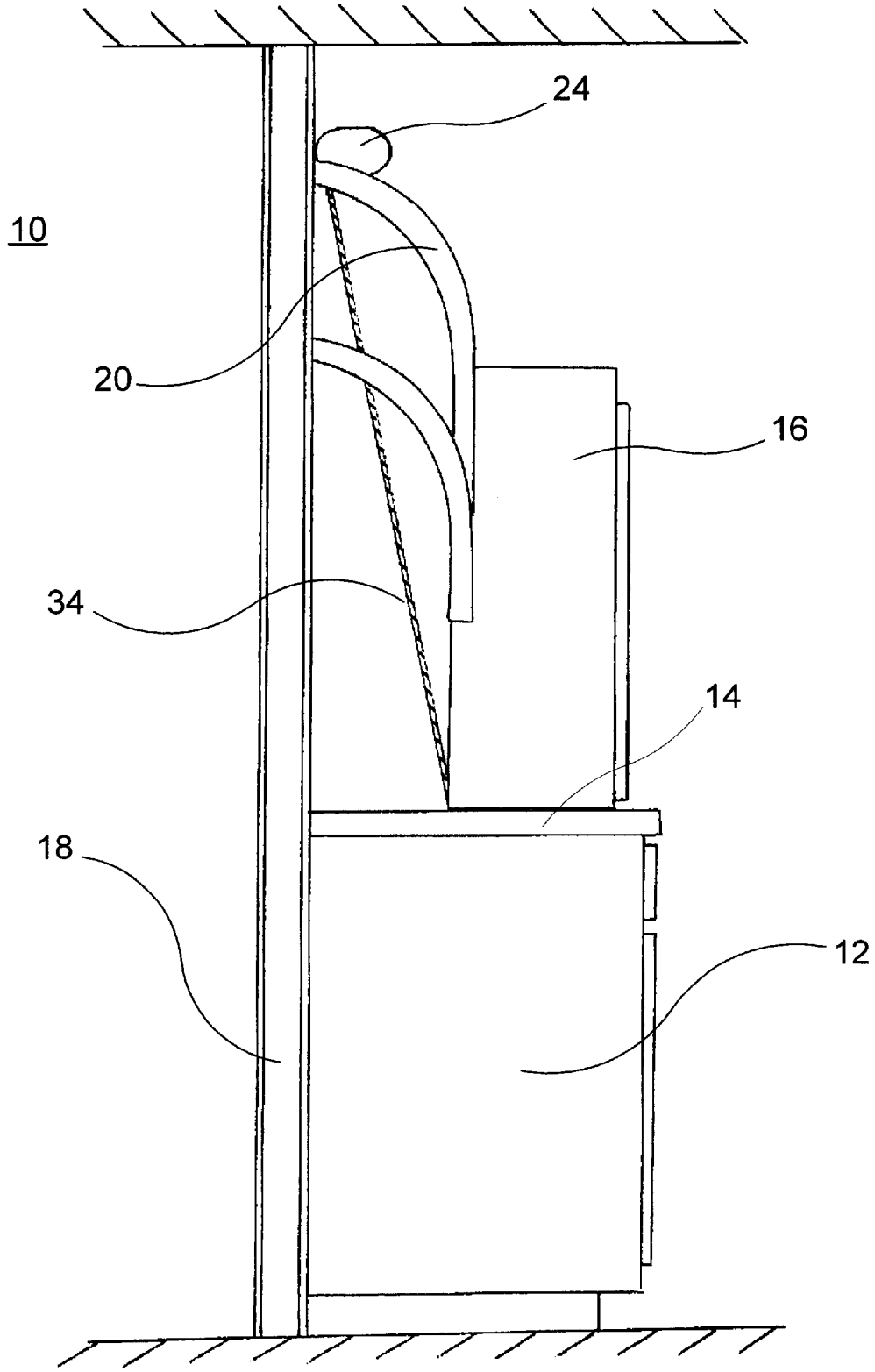
FIG. 2 is a side elevational view of a preferred embodiment of the cabinet assembly of the subject invention. In this view, the cabinet housing is positioned away from a wall.

A preferred embodiment of the cabinet assembly of the subject invention is shown generally at 10 in FIG. 1. In this embodiment, the subject cabinet assembly is installed as an upper kitchen cabinet suspended above a lower cabinet unit 12 and a countertop 14. The cabinet housing 16 moves from a position adjacent a wall 18 (FIG. 1) to a lower position away from the wall (FIG. 2). The cabinet assembly 10 comprises a cabinet housing 16 which moves along tracks 20 on bearings 22 attached to the cabinet housing. A hoist 24 can be used to facilitate movement of the cabinet housing.

Tracks 20 guide bearings 22 attached to the cabinet housing 16 as the cabinet housing moves from one point to the next. The tracks 20 are fixed to a wall 18. In the exemplified embodiment, the tracks guide the cabinet housing down and away from that wall. Therefore, in this embodiment, the tracks 20 are curved or are an arc. The cabinet housing moves along the tracks from a position adjacent to the wall, travels out away from the wall, and lowers to the countertop. The radius of the arc of the tracks in this embodiment is from about 9 inches to about 12 inches and preferably is about 10 inches. Tracks which are an arc and have a 10 inch radius guide the cabinet housing from a position adjacent the wall to a position approximately 10 inches away from the wall and approximately 18 inches lower to the countertop.

In a particularly preferred embodiment, two sets of tracks are used to guide the cabinet housing. The tracks are positioned on either side of the cabinet housing. Tracks positioned on either side of the cabinet housing provide lateral support as the cabinet is moved and distribute the weight of the cabinet and its contents evenly. A single set of tracks however could be used for the cabinet assembly of the subject invention.

In a preferred embodiment a set of two tracks, an upper track and a lower track is used to prevent the cabinet housing from swinging as it is lowered. The upper track guides bearings attached to the upper edge of the cabinet housing, while the lower track guides bearings attached at a midpoint on the exterior of the cabinet housing. A single track would be suitable if, for example, the cabinet housing was moving along a straight path.

The tracks 20 can be made of any material that possesses adequate strength to support and guide the cabinet housing. In a preferred embodiment, the tracks are fashioned of aluminum. Aluminum is a light-weight but strong metal. The weight of the tracks therefore does not damage the wall 18 from which they are suspended. The aluminum tracks however are sufficiently strong and durable to withstand repeated use. Further, aluminum is resistant to corrosion. Other suitable materials for the tracks of the cabinet assembly of the subject invention include, but are not limited to, plastics and steel. The tracks can be simple box tracks sufficient to capture the bearings.

The cabinet assembly of the subject invention is designed for strength, safety and ease of installment. In a particularly preferred embodiment, the tracks 20 are mounted to the wall 18 or other surface by a plate 26. The plate 26 provides strength to the unit distributing the weight of the cabinet housing over the entire surface of the plate. Further, slots 28 in the plate allow for the placement of lag bolts anywhere along the face of the plate insuring the unit will be anchored to a stud. Adjustable lag placement also allows the cabinet to replace any existing cabinet or be placed at any convenient position on a wall. The tracks 20 are fastened to the plate by any suitable means including welding and/or bolting the tracks in place.

Figure 3:
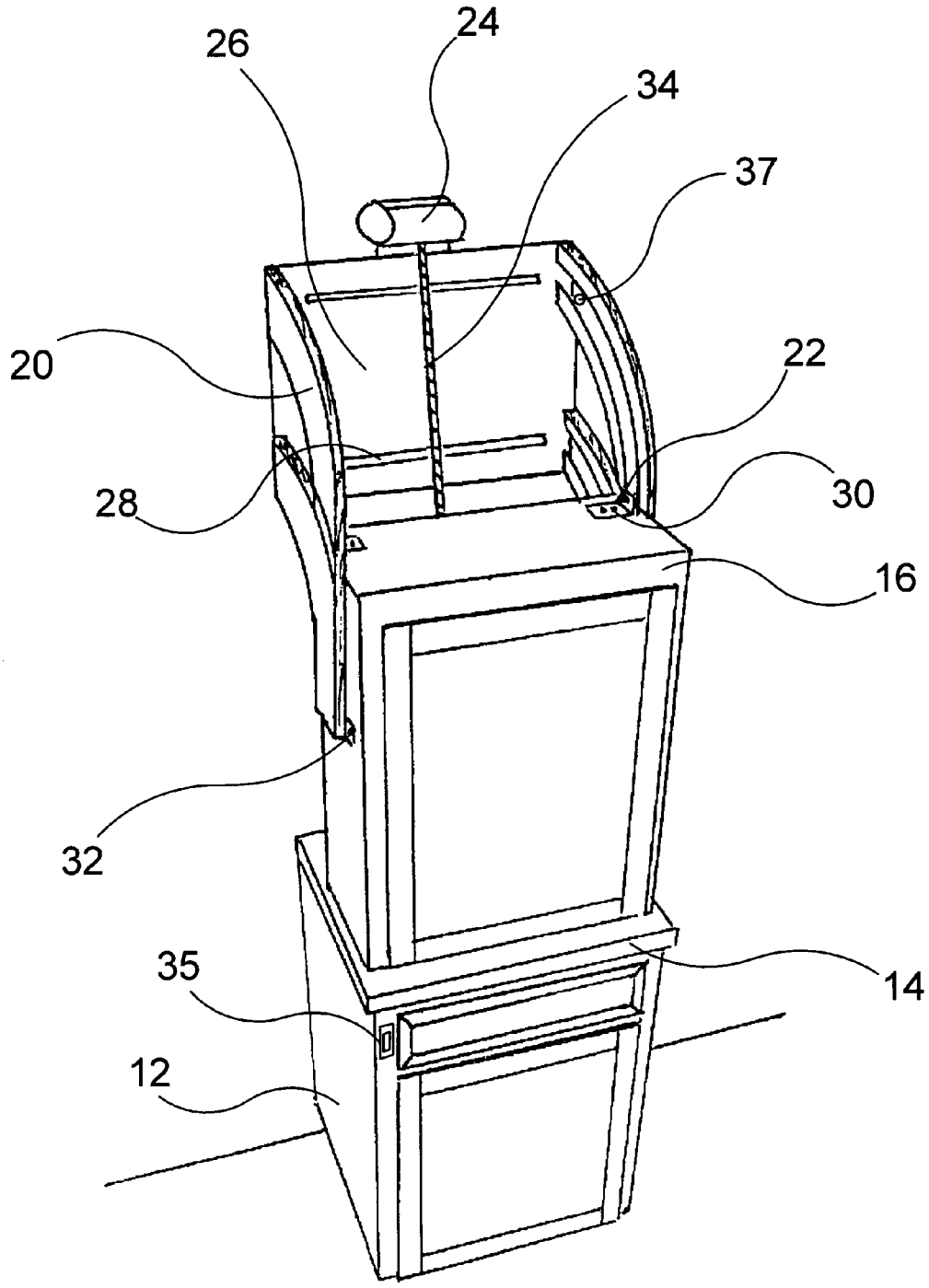
FIG. 3 is a top perspective view of a preferred embodiment of the cabinet assembly of the subject invention.

The tracks 20 guide bearings 22 as the cabinet housing moves along the path of the tracks. The bearings 22 are seen most clearly in FIG. 3 and can be attached to the cabinet housing 16 by any appropriate means. The bearings 22 must be mounted to provide sufficient clearance for the cabinet housing to pivot as it moves along the path of the track. For example, simple L-brackets 30 are sufficient to mount bearings at or near the top of the cabinet housing, while S-brackets 32 provide adequate clearance for mounting bearings on the side of the cabinet housing. Bearings can be any type of bearing including ball bearings but are preferably high-speed needle bearings which are quiet and offer superior precision and durability.

The cabinet housing to which the bearings are attached is generally box-like and, typically have a top, bottom, two sides and a back. The cabinet housing can be constructed of wood, composite materials or fashioned as a single unit from injection molded plastic. A plastic housing unit is very lightweight and the single unit construction is very strong. Ideally, the cabinet housing is the dimension of a standard cabinet unit. For example, a standard upper kitchen cabinet measures 30 inches high, 24 inches wide and 12 inches deep. Face frames and cabinet doors can be applied to the box to match the moveable cabinet to existing cabinetry. Therefore, the cabinet assembly of the subject invention can be substituted for an existing cabinet converting a standard kitchen or storage unit into one that is accessible to everyone.

In a preferred embodiment, a hoist 24 is used in the cabinet assembly of the subject invention to move the cabinet housing along the tracks. Hoists are used to raise or lower objects and typically comprise a drum around which a cable is wound. Hoists, as opposed to winches, are equipped with a double brake system which prevents a load from falling in case of a power failure thus providing added safety. Further, it is preferred that the cable used be chain. Rope or wire cables can flex and twist over time eventually weakening and breaking. Most preferably, the hoist is motorized. A motorized hoist having a lifting capacity of between 300 and 600 pounds is more than adequate to lift a kitchen-type cabinet. Similar hoists are available that conveniently plug into an 110 v outlet.

Hard-wired switches 35 can be used to activate the hoist. Switch controls can be positioned on the face of the lower cabinet 12 or activated by a wireless remote. Electronic sensor mechanisms 37 can be installed at countertop level as well as near the top of the cabinet housing within the tracks to regulate the height at which the hoist stops and to arrest movement of the cabinet housing should something or someone obscure its path.

Figure 4:
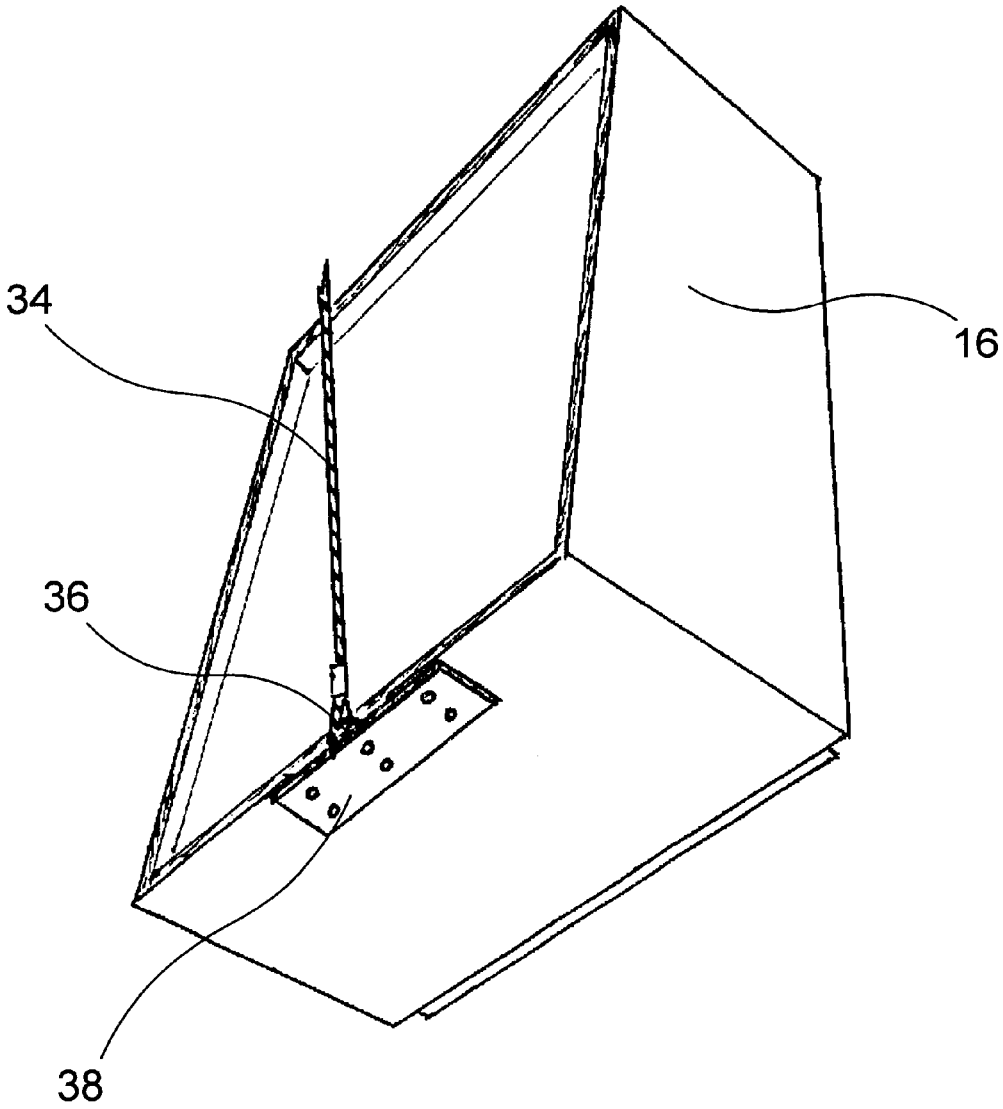
FIG. 4 is a bottom perspective view of the cabinet housing of a preferred embodiment of the cabinet assembly of the subject invention.

Aesthetic modifications can be made to the design of the subject cabinet assembly so that a moveable cabinet appears to be a standard, stationary cabinet. For example, the hoist mechanism can be concealed within the soffit of the room to hide it from view. Further, the hoist chain 34 can be attached to the bottom of the cabinet housing 16 and the back of the cabinet housing 16 can be recessed slightly (i.e., approximately one inch) to accommodate the chain and allow the cabinet sides to be pulled flush against the wall. As shown in FIG. 4, the hoist chain is attached to loop 36 on the periphery of a plate 38 affixed to the bottom of the cabinet housing 16. The cabinet housing 16 can be fitted with a door to match the cabinetry of the remainder of the kitchen or can be left open for easiest access. Contents of the cabinet will not be displaced during movement since a constant attitude is maintained as the housing is moved from adjacent the wall to the countertop.

It is understood that the foregoing examples and embodiments are merely illustrative of the present invention. Certain modifications of the articles of manufacture and/or methods employed may be made and still achieve the objectives of the inventions. Such modification are contemplated as within the scope of the claimed invention.

What is claimed is:

1. A cabinet assembly comprising:

a cabinet housing, said cabinet housing comprising a top, a bottom, a back and two opposing sides, said back of said cabinet housing disposed against a vertical wall;

at least two roller bearings attached to each side of said cabinet housing; and at least two continuously curved tracks are attached to said vertical wall, with each track being adjacent to a respective side of said cabinet housing, wherein said cabinet housing moves reversibly along said tracks on said bearings from a position adjacent said vertical wall to a position away from said vertical wall while maintaining a constant attitude.

2. The cabinet assembly of claim 1, wherein said tracks are curved in an arc having a radius of from about 9 inches to about 12 inches.

3. The cabinet assembly of claim 2, wherein said tracks are an arc having a radius of 10 inches.

4. The cabinet assembly of claim 1, wherein said tracks are attached to said vertical wall by a plate.

5. The cabinet assembly of claim 1 further comprising a hoist.

6. The cabinet assembly of claim 5, wherein said hoist is motorized.

7. The cabinet assembly of claim 5, further comprising a switch to activate said hoist.

8. The cabinet assembly of claim 1, further comprising sensors to detect the position of said cabinet housing.

* * * * *